United States Patent [19]

Punwani et al.

[11] Patent Number: 4,954,246

[45] Date of Patent: Sep. 4, 1990

[54] SLURRY-PHASE GASIFICATION OF CARBONACEOUS MATERIALS USING ULTRASOUND IN AN AQUEOUS MEDIA

[75] Inventors: Dharamvir Punwani, Naperville; Michael C. Mensinger, Darien, both of Ill.

[73] Assignee: Institute of Gas Technology, Chicago, Ill.

[21] Appl. No.: 175,869

[22] Filed: Mar. 31, 1988

[51] Int. Cl.[5] ..... C10G 1/00

[52] U.S. Cl. ..... 208/402; 208/435; 48/197 R

[58] Field of Search ..... 208/402, 404, 405, 406, 208/414, 419, 417, 427, 435; 48/197 R, 200, 171, 98, 214 A, DIG. 7; 204/158 S

[56] References Cited

U.S. PATENT DOCUMENTS

| | | | |
|---|---|---|---|
| 2,777,813 | 1/1957 | Totzek . | |
| 3,557,337 | 5/1971 | Kessler et al. . | |
| 3,915,670 | 10/1975 | Lacey et al. | 48/214 A |
| 4,007,019 | 2/1977 | Slater et al. | 48/200 X |
| 4,050,907 | 9/1977 | Brimhall | 48/111 |
| 4,108,759 | 8/1978 | Young | 208/402 |
| 4,118,282 | 10/1978 | Wallace | 48/111 X |
| 4,304,656 | 12/1981 | Lee . | |
| 4,391,608 | 7/1983 | Dondelewski . | |
| 4,400,203 | 8/1983 | Kydd et al. | 208/417 X |
| 4,429,506 | 7/1985 | Smit . | |
| 4,473,460 | 9/1984 | Küerten et al. | 208/417 |
| 4,575,380 | 3/1986 | Yaghmaie et al. | 208/426 X |
| 4,728,418 | 3/1988 | Shabtai et al. | 208/413 |

OTHER PUBLICATIONS

Exxon Catalytic Coal Gasification Predevelopment Program, Final Project Report, FE-2369-24 to U.S. DOE, Contract No. E(49-18)-2369, Dec., 1978, pp. 89-92.

"Project Eastern Coal: Conversion of Coal into Liquids", U.S. Office of Coal Research, Res. Develop. Rep., May 18, 1970.

"Means of Increasing Yield of Extracts from Mined Coal", Baranov, S. N., N. K. Neronin and G. V. Samoylenko, Physical Technical Inst., Ukrainian SSR. V1, pp. 24-25, Jan. 1983.

"Application of Ultrasound in the Extraction of Heat--Treated Coal", Lesniak, K. Koks, Smola, Gaz 25, No. 6, p. 137, Jun. 1980.

"Investigation of the Influence of Ultrasound on the Yield, Composition, and Properties of Peat Bitumens", Novichkova, Smirnova, Gurinova, Kalinin Polytech Inst., USSR *Solid Fuel Chem.*, 9, No. 6, p. 64, 1975.

"Putting Chemical Reactions on a Sound Footing", G. M. Graff, *Chemical Engineering*, Mar. 1985.

*Primary Examiner*—Glenn Caldarola

*Attorney, Agent, or Firm*—Thomas W. Speckman

[57] ABSTRACT

A process for slurry-phase gasification of carbonaceous feedstock materials is provided wherein feedstock materials are combined with a liquid to form a feedstock slurry. Product gases are formed from the feedstock slurry in a gasifier reaction vessel in the presence of elevated temperatures and pressures and ultrasonic energy. Gasification catalysts may be utilized to provide increased reaction rates. The process of the present invention provides enhanced conversion of carbonaceous solids feedstock to gaseous products comprising primarily methane and carbon dioxide with some higher organic liquids.

20 Claims, 1 Drawing Sheet

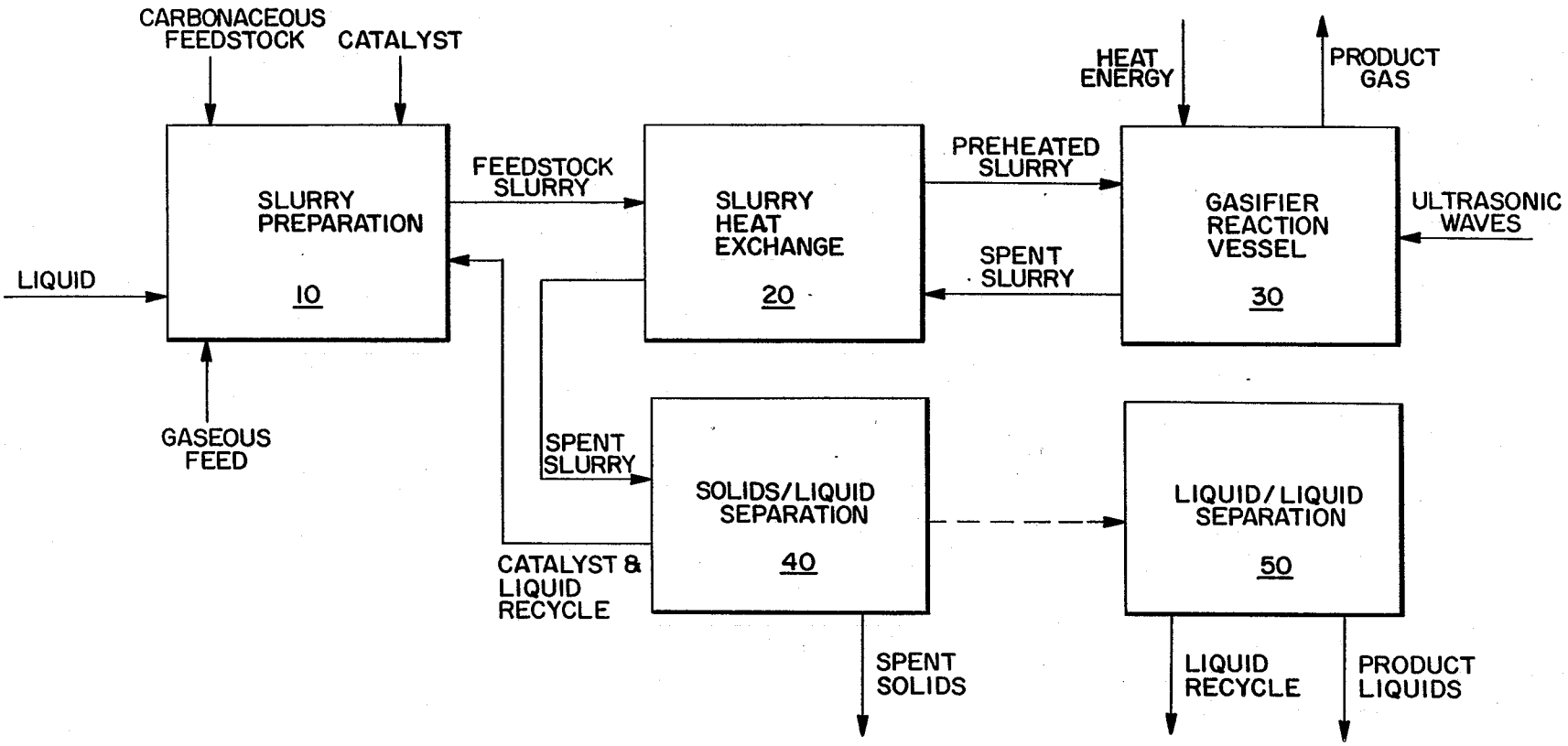
CARBONACEOUS FEEDSTOCK
CATALYST
SLURRY PREPARATION
10
LIQUID
GASEOUS FEED
FEEDSTOCK SLURRY
SLURRY HEAT EXCHANGE
20
PREHEATED SLURRY
SPENT SLURRY
HEAT ENERGY
GASIFIER REACTION VESSEL
30
PRODUCT GAS
ULTRASONIC WAVES
SPENT SLURRY
CATALYST & LIQUID RECYCLE
SOLIDS/LIQUID SEPARATION
40
SPENT SOLIDS
LIQUID/LIQUID SEPARATION
50
LIQUID RECYCLE
PRODUCT LIQUIDS

SLURRY-PHASE GASIFICATION OF CARBONACEOUS MATERIALS USING ULTRASOUND IN AN AQUEOUS MEDIA

BACKGROUND OF THE INVENTION

1. Field of the Invention

The present invention relates to a process for slurry-phase gasification of carbonaceous materials using ultrasonic treatment. The process of the present invention produces gaseous fuels, primarily methane and carbon dioxide, from carbonaceous materials at temperatures and pressures substantially lower than conventional thermal processes.

2. Description of the Prior Art

Theoretically, the ideal overall reaction for production of methane from carbonaceous materials proceeds as follows:

$$2C + 2H_2O \leftrightarrow CO_2 + CH_4$$

This reaction is promoted in the desired direction at relatively low temperatures of below about 800° F. In the practice of conventional thermal gasification processes, however, significant amounts of carbon monoxide and hydrogen may also be formed by means of the following simplified reaction paths:

$$C + H_2O \leftrightarrow CO + H_2$$

$$C + 2H_2O \leftrightarrow CO_2 + 2H_2$$

$$3C + 2H_2O \leftrightarrow 2CO + CH_4$$

Separation of the gaseous products and conversion or disposal of the undesired product gases requires extensive equipment and entails high costs, thus significantly lowering process efficiencies.

Conventional thermal processing techniques for producing gaseous products from carbonaceous materials require severe operating conditions of temperature and pressure to achieve acceptable rates of product formation. Thermal gasification techniques typically employ operating temperatures in excess of 1500° F. and pressures of up to 1000 psig. Maintenance of the high temperatures and pressures required for such thermal processing techniques increases process equipment and fuel costs and reduces process efficiency. Moreover, maintenance of process operating temperatures in excess of about 800° F. tends to promote secondary reactions forming undesirable product gases such as carbon monoxide and hydrogen. Even catalytic coal gasification processes which are known to the art, such as the process described in Exxon Catalytic Coal Gasification Predevelopment Program, Final Project Report, FE-2369-24, to U.S. D.O.E., Contract No. E(49-18)-2369, December, 1978, require process temperatures on the order of at least about 1200° F. and elevated process pressures. Furthermore, in the practice of prior art coal gasification processes, catalyst recovery is generally very low due to reaction of the catalyst with coal ash, increasing the overall process cost.

U.S. Pat. No. 4,391,608 teaches beneficiation of ground coal in a liquid slurry subjected to ultrasonic energy at frequencies of about 20 to 40 kHz, wherein the liquid slurry preferably comprises a small amount of oil. The '608 patent teaches that maximum temperatures of less than about 170° F. should be maintained during ultrasonic treatment. After beneficiation, the content. U.S. Pat. No. 4,529,506 teaches cleaning of pulverized coal in a liquid slurry containing a surfactant subjected to ultrasonic treatment.

Several U.S. Patents teach solvent extraction of carbonaceous materials utilizing ultrasonic energy. U.S. Pat. No. 3,557,337 teaches that solvent extraction of coal subjected to ultrasonic waves at frequencies of 80 kHz permits ambient temperature use of quinoline solvent. Improved solvent extraction of coal at temperatures on the order of 75° to 200° F. utilizing ultrasonic energy has been observed by several researchers. "Project Western Coal: Conversion of Coal into Liquids", U.S. Office of Coal Research, Res. Develop. Rep., May 18, 1970; "Means of Increasing Yield of Extracts from Mined Coal", Baranov, S.N., N.K. Neronin and G.V. Samoylenko, Physical Technical Inst., Ukrainian SSR, V.1, pgs. 24-25, Jan. 1983; "Application of Ultrasound in the Extraction of Heat-Treated Coal", Lesniak, K., KOKS, SMOLA, GAZ 25, No. 6, p. 137, June 1980. Solvent extraction of organic materials from peat using ultrasonic waves at frequencies of 22 kHz has been demonstrated to provide increased yields and reaction rates. "Investigation of the Influence of Ultrasound on the Yield, Composition, and Properties of Peat Bitumens", Novichkova, Smirnova, Gurinova, Kalinin Polytech Inst., USSR *Solid Fuel Chem.*, 9, No. 6, p. 64, 1975. Solvent recovery of oil from tar sands using ultrasonic waves at frequencies of 20 kHz has also been investigated. "Putting Chemical Reactions on a Sound Footing", G. M. Graff, *Chemical Engineering, March,* 1985. U.S. Pat. No. 4,304,656 teaches extraction of shale oil from oil shale by compression and ultrasonic treatment at frequencies of 20 kHz.

U.S. Pat. No. 2,777,813 teaches production of water-gas from pulverized coal reacted in a gas stream using sonic energy at frequencies of about 2 to 7 kHz. The '813 patent teaches reduced production at increased frequencies of 20 kHz.

U.S. Pat. No. 4,108,759 teaches thermal gasification of coal with superheated steam in the presence of heat at 1800° to 2000° F. producing hydrogen for hydroliquefaction of pulverized coal in a slurry of an organic hydrogenating liquid, such as hydrophenanthrene, in an oxygen-free liquefier vessel maintained at 350° to 750° F. under pressures of 750 to 2000 psi and utilizing ultrasonic energy at a very specific frequency matching the relaxation frequency of components of the liquid product oil.

SUMMARY OF THE INVENTION

It is an objective of the present invention to provide a process for the slurry-phase production of gaseous fuels from carbonaceous materials.

It is another objective of the present invention to provide a process for gasification of carbonaceous solids utilizing ultrasonic energy in a slurry-phase gasification process which allows reduced temperatures and/or reduced residence times compared to those required by prior art processes.

It is yet another objective of the present invention to provide an improved process for gasification of carbonaceous solids in a slurry in the presence of a gasification catalyst utilizing ultrasonic treatment.

It is yet another objective of the present invention to provide a process for slurry-phase gasification of carbonaceous materials using ultrasonic treatment which provides enhanced conversion of carbonaceous solids to gaseous products comprising primarily methane and carbon dioxide, and which provides enhanced overall process efficiency.

Carbonaceous materials such as coal, peat, oil shale, biomass, municipal and other wastes, mixtures thereof, and the like, are suitable for use in the process of the present invention. The use of cleaned coals having a low ash content is especially preferred in applications where catalysts react with minerals in the feed and reduce catalyst recovery. Use of cleaned carbonaceous solids feedstocks having low ash contents also produces spent char having a high carbon content, which may provide fuel for process power or heat generation means.

The carbonaceous material feedstock is ground to an appropriate size fraction and mixed with liquid in proportions suitable to provide a pumpable slurry Carbonaceous solids feedstocks having small particle sizes are preferred for use in the present invention to increase the solids feedstock surface area available for reaction, thus providing increased gasification rates. Water, organic liquids, or molten salts may be used for slurrying, depending upon the type of carbonaceous solids feedstock being processed. The slurry slurry-phase reaction is utilized in the process of the present invention because ultrasonic waves are more efficient in the presence of a liquid phase. Gasification catalysts may also be employed in the process of the present invention. A gasification catalyst may be added to the slurry in sufficient quantities as required to increase the rate of gasification reactions.

Feedstock slurry is preferably preheated by heat exchange with spent slurry withdrawn from the reaction vessel prior to being introduced into the enclosed gasification reaction vessel. The feedstock slurry is then heated to reaction temperatures on the order of about 200° to about 1000° F., and preferably about 400° to about 750° F., in the gasification reaction vessel. The comparatively low temperatures required by the process of the present invention are advantageous from the standpoint that secondary gasification reactions which produce undesirable gaseous products such as carbon monoxide and hydrogen are suppressed at temperatures below about 700° F. If an aqueous feedstock slurry is employed, the slurry is preferably heated to reaction temperatures with superheated steam, and the reaction temperature is maintained below 705° F., the critical temperature of water. Elevated pressures are also maintained in the gasification reaction vessel. When an aqueous slurry is used, operating pressures are preferably maintained at about 50 to 100 psi greater than the corresponding vapor pressure of water at the bulk fluid temperature.

The feedstock slurry in the reaction vessel at suitable operating temperatures and pressures is treated with ultrasonic energy at frequencies from about 20 to about 55 kHz, for residence times on the order of about one minute to about two hours. Product gas may be withdrawn from the reaction vessel as necessary to maintain desired process operating pressures. The product gas comprises primarily methane and carbon dioxide, and may be used directly as process fuel gas, or may be upgraded to provide a high-Btu gas.

Spent feedstock slurry is withdrawn from the gasification reaction vessel after the desired residence time has elapsed. Unreacted and spent solids may be separated from the process liquid by filtration and centrifugation. The unreacted and spent solids may be combusted to generate process power, or may be removed for further treatment or disposal. Liquid and catalyst separated from the unreacted and spent solids is preferably recycled to the slurry preparation step.

Suitable gasification catalysts may also be added to the carbonaceous solids feedstock slurry to accelerate the formation of gasification products. Heavier hydrocarbons and oxygenated hydrocarbons may be produced in the reaction vessel and may be separated from the slurry liquid by extraction or distillation, and the separated slurry liquid is preferably recycled to the slurry separation. Gasification catalysts which have been added to the feedstock slurry are thus conserved and recycled with the process liquid to provide catalyst for further process reactions. Make-up catalyst may be added to provide desired catalyst concentration.

The process of the present invention provides numerous advantages over prior art gasification processes. Gasification occurs under overall thermal efficiency. There is no need for pressurized solids feed means such as lockhoppers, no need for a catalytic CO-shift converter unit, a catalytic methanation unit, or an oxygen plant, and recycling of carbon monoxide and hydrogen is unnecessary. The process provides high catalyst recycling. Overall, the process of the present invention provides an increased direct methane yield at a lower capital cost and higher overall thermal efficiency.

BRIEF DESCRIPTION OF THE DRAWINGS

Further features of the invention will be apparent from the following more detailed description read in conjunction with the drawing which shows a highly schematic flow diagram illustrating the basic features of the process of the present invention.

DESCRIPTION OF PREFERRED EMBODIMENTS

Carbonaceous materials feedstock for use in the present invention may comprise coal, peat, biomass, oil shale, other carbonaceous solids and mixtures thereof. The term "biomass" is meant to include terrestrial and aquatic plant materials (energy crops) and organic wastes, such as sewage sludge, animal wastes, municipal solids wastes, forestry wastes, agricultural wastes, industrial wastes, and the like. Some of the carbonaceous feedstock may be in the liquid phase. The feedstock for the gasification process of this invention does not have to be dry, saving considerable energy over other processes. Solids sizes of about −10 mesh, corresponding to an average particle diameter of about 10 to about 1000 microns. Cleaned and/or beneficiated coals having a low ash and low pyritic sulfur content are especially preferred carbonaceous solids feedstocks. Physical coal cleaning processes which are capable of reducing the ash content of coals by about 90 percent are known to the art. Many of the prior art coal cleaning processes produce coals having very small particle sizes, which provide a larger chemical reaction surface area and thus significantly increase gasification rates. Finely divided, about 5 microns being the lower size obtained by grinding, cleaned coals, such as cleaned by advanced physical solvent extraction processes, are especially preferred for use in the practice of the present invention.

Carbonaceous solids feedstock of a suitable size fraction is combined with a liquid to form a pumpable slurry in slurry preparation means 10. The amount of solids to liquid is variable with respect to type and solids size to maintain a pumpable slurry. Using coal of −40+60 mesh size about 10 to about 35 weight percent solids is suitable, about 10 to about 20 weight percent solids being preferred. An aqueous liquid is generally preferred for use in slurry preparation of high water content feedstocks, such as sludges, according to the present invention, but non-aqueous solvents, such as phenoxides, and molten salts may be preferred for use with certain other types of carbonaceous solids feedstocks.

Feedstock slurry is conveyed from slurry preparation means 10 and introduced into ultrasonic gasifier reaction vessel 30. Feedstock slurry is preferably preheated in slurry heat exchange means 20 by heat exchange with spent slurry which has been withdrawn from ultrasonic gasifier reaction vessel 30, as shown in the schematic drawing. Suitable types of heat exchange means are well known to the art. Preheated feedstock slurry is then conveyed to ultrasonic gasifier reaction vessel 30, where the feedstock slurry is heated to reaction temperatures of about 400° F. to about 1000° F., and preferably about 500° F. to about 750° F. Preferred temperature ranges will vary, of course, with the type of carbonaceous feedstock being treated and the composition of the liquid comprising the slurry.

According to a preferred embodiment of the process utilizing an aqueous liquid slurry, the reaction temperature in ultrasonic gasifier reaction vessel 30 is maintained below the critical temperature of water, about 705° F., and reaction pressures are maintained at about 50 to about 100 psi greater than the corresponding vapor pressure of water at the bulk fluid temperature. When an aqueous feedstock slurry is employed, the feedstock slurry may be heated to reaction temperatures with steam or superheated steam. When non-aqueous slurries are used, the reaction vessel may be heated by indirect means. When non-aqueous slurries are used, the reaction temperature is maintained below the critical temperature of the liquid used and reaction pressures are maintained greater than the corresponding vapor pressure at the bulk fluid temperature.

Feedstock slurry in ultrasonic gasifier reaction vessel 30 is treated with ultrasonic waves at frequencies of about 20 to about 50 kHz. Ultrasonic irradiation used in the process of this invention may be generated by ultrasonic generators as known to the art. In using such ultrasonic generators, the electrical wattage is generally proportional to ultrasonic intensity. The ultrasonic irradiation may be continuous or pulsed. To effect the desired increase in hydrocarbons production, it is necessary to exceed a threshold ultrasonic intensity for the desired conversion, feedstock and reaction conditions. There will then be an increase in hydrocarbons production with increase in ultrasonic intensity up to a maximum conversion rate following which conversion will decrease with increased ultrasonic intensity. An effective ultrasonic intensity may be readily ascertained for a particular reaction system. Hydrocarbon production rates increase rapidly upon application of an effective intensity of ultrasonic irradiation. In some cases, production of hydrocarbons may reach a peak rate within a few minutes following which there is a decline during continuous ultrasonic irradiation. However, it may be possible to achieve sustained production of hydrocarbons at high rates, without the peaking phenomena by proper selection of reactor configuration, mixing, and ultrasound characteristics. Feedstock slurry residence times of about one minute to about one hour are suitable for most types of feedstock solids, about three to about forty-five minutes being preferred. Use of ultrasonic energy as described herein facilitates slurry-phase gasification of carbonaceous solids to produce product gases comprising primarily methane and carbon dioxide and dissolved organic materials. Agitation of the gasifier vessel contents during ultrasonic treatment is preferred for most applications. Product gases may be withdrawn from the ultrasonic gasifier reaction vessel as necessary to maintain desired process pressures. It is readily apparent that the gasifier may be operated in a batch or in a continuous mode.

Spent feedstock slurry comprising liquid and unreacted and spent feedstock solids is withdrawn from ultrasonic gasifier reaction vessel 30 after suitable retention times and is preferably passed through slurry heat exchange means 20 in heat exchange relationship with feedstock slurry being introduced to gasifier reaction vessel 30. Heat energy from the spent feedstock slurry is thereby utilized to preheat feedstock slurry prior to its introduction into gasifier vessel 30. solids/liquid separation means 40 wherein slurry liquid is separated from unreacted and spent feedstock solids. Suitable means for separating liquids from solids, such as filtration, centrifugation, and the like are well known to the art. Slurry liquid is preferably recycled for introduction into slurry preparation means 10. Unreacted and spent feedstock solids may, depending upon their composition, be combusted to provide process energy, or may be utilized for other purposes. In a preferred embodiment utilizing cleaned coals having a low ash content as feedstock solids, the unreacted and spent solids, comprising primarily coal char, may be substantially completely combusted to provide process power or heat.

According to a preferred embodiment of the gasification process of the present invention, the feedstock slurry additionally comprises a gasification catalyst, and in an especially preferred embodiment, aqueous feedstock slurry additionally comprises a water soluble gasification catalyst, such as potassium hydroxide, potassium carbonate, lithium hydroxide, cesium hydroxide, or other water soluble gasification catalysts which are known to the art.

In some embodiments of this invention it may be desired to separate formed heavier hydrocarbon and oxygenated hydrocarbon liquids from the slurry liquid. This may be achieved in liquid/liquid separator 50 by any suitable means known to the art, such as by extraction or distillation, and the separated slurry liquid recycled to slurry preparation means 10.

According to preferred embodiments of the process of the present invention wherein gasification catalysts are introduced into the feedstock slurry and slurry liquid is recycled to the feedstock slurry preparation means, most of the liquid and catalyst is recovered and only small amounts of make-up liquid and make-up catalyst need be added to the feedstock slurry.

The following examples using specific materials and process conditions are set forth for specific exemplification of the process of this invention and should not be considered as limiting the invention.

EXAMPLE I

An aqueous slurry of North Dakota Indianhead lignite having particle size −40+60 mesh was slurried with water with a solids concentration of 14.1 weight percent. Potassium hydroxide an amount of 33.1 weight percent of the coal was added to the slurry as a catalyst.

The slurry was charged to a small stainless steel beaker $2\frac{1}{4}$ inches in diameter by $6\frac{5}{8}$ inches tall fitted to a cooling coil in a 3 liter pressure vessel. The small size beaker was used to permit more intense irradiation of the slurry by decreasing the slurry volume directly exposed to the ultrasonic irradiation. The annular space between the beaker and the pressure vessel was filled with deionized water to a level higher than the slurry level in the beaker so that water lost by evaporation from the beaker could be replaced by flow from the annular space to inside the beaker. Argon was used as a purge gas at a flow rate of 120 liters per hour. The slurry was maintained at 550° F. by an electric mantle furnace and 1035 psig (delta P, total pressure minus water vapor pressure, of about 50 psi) for about 60 minutes, until the concentrations of hydrocarbon gases and carbon dioxide became steady to establish baseline values. Ultrasonic irradiation was then applied using a 15/16 inch diameter ultrasonic horn having a titanium face and a booster of 1.5:1 (ratio of output wave amplitude to input wave amplitude) operated at 20 kHz. The ultrasonic power draw was 650 Watts which was 31.2 Watts/gram coal charged. On-line gas analysis of hydrocarbons and carbon dioxide was made with the results shown in the following table:

TABLE 1

| | mL/gr Carbon Charged/min | |
|---|---|---|
| | Hydrocarbons | $CO_2$ |
| 60 min. prior to sonication (average) | 0.068 | 0.216 |
| Immed. prior to sonication | 0.098 | 0.337 |
| During sonication | | |
| Average | 0.219 | 0.977 |
| Peak | 0.424 | 1.824 |

As shown in Table 1, sonication increased the hydrocarbons production rate by a maximum of 4.3 times and the $CO_2$ production rate by a maximum of 5.4 times. The production rates peak within a few minutes after commencement of ultrasonic irradiation and then decrease with time of continued irradiation.

Further tests show that under the above general conditions it is necessary to have an ultrasonic power of greater than about 10 to about 20 Watts/gram coal charged to result in increased hydrocarbons production. Increased $CO_2$ production is obtained at lower ultrasonic power.

EXAMPLE II

A slurry-phase gasification was carried out using the materials and under the conditions set forth in Example I except that the solids concentration of the slurry was 14.9 weight percent and no catalyst was used. The ultrasonic power draw was 585 Watts which was 21.8 Watts/gram coal charged. Results are shown in the following table.

TABLE 2

| | mL/gr Carbon Charged/min | |
|---|---|---|
| | Hydrocarbons | $CO_2$ |
| 60 min. prior to sonication (average) | 0.038 | 0.421 |
| Immed. prior to sonication | 0.040 | 0.205 |
| During sonication | | |
| Average | 0.060 | 0.300 |
| Peak | 0.077 | 0.717 |

As shown in Table 2, sonication increased the hydrocarbons production rate by a maximum of 1.9 times and the $CO_2$ production rate by a maximum of 3.5 times. Example II shows the effectiveness of ultrasonic irradiation for slurry-phase gasification of carbonaceous materials without a catalyst present.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein may be varied considerably without departing from the basic principles of the invention.

We claim:

1. A process for slurry-phase gasification of carbonaceous materials comprising:

combining solid carbonaceous feedstock materials with a slurry liquid to form a feedstock slurry;

conveying said feedstock slurry to a gasifier reaction vessel;

gasifying said carbonaceous feedstock in said gasifier vessel in slurry phase at reaction temperatures from about 200° F. to about 1000° F. at elevated pressures and in the presence of water and an effective intensity of ultrasonic waves having a frequency of about 20 kHz to about 55 kHz to form product gases comprising primarily methane and carbon dioxide.

2. A process in accordance with claim 1 wherein said carbonaceous materials is selected from the group consisting of coal, peat, oil shale, biomass, and mixtures thereof.

3. A process in accordance with claim 2 wherein said carbonaceous materials comprise finely divided cleaned coal having a low ash content.

4. A process in accordance with claim 1 wherein said slurry liquid is selected from the group consisting of water, an organic liquid, a molten salt, and mixtures thereof.

5. A process in accordance with claim 4 wherein said slurry liquid comprises water.

6. A process in accordance with claim 1 wherein said feedstock slurry additionally comprises a gasification catalyst.

7. A process in accordance with claim 6 wherein said gasification catalyst is selected from the group consisting of potassium hydroxide, potassium carbonate, lithium hydroxide, cesium hydroxide, and mixtures thereof.

8. A process in accordance with claim 7 wherein said gasification catalyst comprises potassium hydroxide.

9. A process in accordance with claim 1 wherein said reaction temperatures in said gasifier reaction vessel are maintained at about 400° F. to about 750° F.

10. A process in accordance with claim 1 wherein said elevated pressures in said gasifier vessel are maintained at about 50 to about 100 psig greater than the corresponding vapor pressure of said slurry liquid at the bulk fluid temperature.

11. A process in accordance with claim 1 additionally comprising withdrawing spent feedstock slurry from said gasifier reaction vessel and preheating said feedstock slurry by passing it in heat exchange relationship with said spent feedstock slurry.

12. A process in accordance with claim 1 additionally comprising conveying said spent feedstock slurry to a solids/liquid separation means, separating unreacted and spent carbonaceous solids from slurry liquid, and recycling said slurry liquid for combination with said carbonaceous feedstock solids to form said feedstock slurry.

13. A process in accordance with claim 12 additionally comprising combusting said unreacted and spent carbonaceous solids to provide heat.

14. A process in accordance with claim 12 wherein said slurry liquid separated from unreacted and spent carbonaceous solids in said solids/liquid separation means is conveyed to a liquid/liquid separation means wherein at least one product liquid selected from the group consisting of heavier hydrocarbons and oxygenated hydrocarbons is separated from said slurry liquid.

15. A process in accordance with claim 1 additionally comprising agitating said feedstock slurry in said gasifier reaction vessel.

16. A process in accordance with claim 1 wherein said feedstock slurry is treated in said gasifier reaction vessel for residence times of about one minute to about two hours.

17. A process in accordance with claim 1 wherein said feedstock slurry is treated in said gasifier reaction vessel for residence times of about 3 minutes to about 45 minutes.

18. A process in accordance with claim 1 wherein said carbonaceous materials comprise finely divided cleaned coal having a low ash content, said slurry liquid comprises water, said reaction temperatures in said gasifier reaction vessel are maintained at about 400° to about 750° F., and said elevated pressures in said gasifier vessel are maintained at about 50 to about 100 psi greater than the corresponding vapor pressure of water at the bulk fluid temperature.

19. A process in accordance with claim 18 wherein said gasification catalyst is selected from the group consisting of potassium hydroxide, potassium carbonate, lithium hydroxide, cesium hydroxide, and mixtures thereof.

20. In a process for gasification of solid carbonaceous materials, the improvement comprising:

gasifying solid carbonaceous feedstock materials in an aqueous slurry in a gasifier vessel at reaction temperatures from about 200° F. to about 1000° F. at elevated pressures and in the presence of an effective intensity of ultrasonic waves having a frequency of about 20 kHz to about 55 kHz to form product gases comprising primarily methane and carbon dioxide.

* * * * *